US010363949B2

(12) United States Patent
Meyer et al.

(10) Patent No.: US 10,363,949 B2
(45) **Date of Patent: *Jul. 30, 2019**

(54) SYSTEM AND METHOD FOR CONTROLLING A VEHICLE SYSTEM

(71) Applicant: General Electric Company, Schenectady, NY (US)

(72) Inventors: Brian Nedward Meyer, Fairview, PA (US); Harry Kirk Mathews, Jr., Niskayuna, NY (US); James D. Brooks, Niskayuna, NY (US); Kristopher Ryan Smith, Melbourne, FL (US)

(73) Assignee: GE GLOBAL SOURCING LLC, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/864,518

(22) Filed: Jan. 8, 2018

(65) Prior Publication Data

US 2018/0148077 A1 May 31, 2018

Related U.S. Application Data

(63) Continuation of application No. 15/058,772, filed on Mar. 2, 2016, now Pat. No. 9,862,397.

(Continued)

(51) Int. Cl.

| | |
|---|---|
| ***B61L 27/00*** | (2006.01) |
| ***B61L 3/00*** | (2006.01) |
| *B61L 25/02* | (2006.01) |

(52) U.S. Cl.

CPC ..... *B61L 27/0022* (2013.01); *B61L 3/006* (2013.01); *B61L 27/0016* (2013.01);

(Continued)

(58) Field of Classification Search

CPC ..... B61L 27/0022

See application file for complete search history.

(56) References Cited

U.S. PATENT DOCUMENTS

| | | | | |
|---|---|---|---|---|
| 5,436,538 | A | 7/1995 | Garvey et al. | |
| 8,543,261 | B2 * | 9/2013 | Anderson | B60W 30/09 701/3 |

(Continued)

FOREIGN PATENT DOCUMENTS

| | | | |
|---|---|---|---|
| CN | 2673749 | Y | 1/2005 |
| CN | 101356089 | A | 1/2009 |
| CN | 101535114 | A | 9/2009 |

OTHER PUBLICATIONS

Machine Translation and First office action and search issued in connection with corresponding CN Application No. 201680013742.5 dated Dec. 25, 2018.

(Continued)

*Primary Examiner* — Alex C Dunn

(74) *Attorney, Agent, or Firm* — Christopher R. Carroll; The Small Patent Law Group LLC

(57) ABSTRACT

A system (e.g., a control system) includes a sensor configured to monitor an operating condition of a vehicle system during movement of the vehicle system along a route. The system also includes a controller configured to designate one or more operational settings for the vehicle system as a function of time and/or distance along the route.

21 Claims, 3 Drawing Sheets

Related U.S. Application Data

(60) Provisional application No. 62/128,290, filed on Mar. 4, 2015.

(52) U.S. Cl.
CPC ..... *B61L 27/0027* (2013.01); *B61L 25/025* (2013.01); *B61L 2205/04* (2013.01)

(56) References Cited

U.S. PATENT DOCUMENTS 8,655,516 B2 2/2014 Noffsinger et al.
9,201,409 B2 12/2015 Kumar et al.
9,221,477 B2 12/2015 Cooper et al.
9,229,448 B1 1/2016 Luther et al.
9,233,696 B2 1/2016 Kumar et al.
9,260,107 B2 * 2/2016 Doering ..... B60K 6/48
9,279,691 B2 * 3/2016 Kaehler ..... G05D 1/0212
9,283,954 B2 * 3/2016 Dalum ..... H01M 10/48
2002/0096375 A1 * 7/2002 Schmitz ..... B60W 20/13 180/65.245
2003/0182030 A1 9/2003 Kraeling et al.
2006/0266044 A1 * 11/2006 Donnelly ..... B60L 7/06 60/698
2007/0053769 A1 * 3/2007 Schlanger ..... F04D 27/004 415/13
2008/0246338 A1 * 10/2008 Donnelly ..... B60L 11/123 307/54
2008/0288132 A1 * 11/2008 King ..... B60L 11/123 701/22
2010/0030447 A1 * 2/2010 Smyth ..... B60W 10/06 701/102
2010/0262321 A1 10/2010 Daum et al.
2013/0018531 A1 * 1/2013 Kumar ..... B61L 3/006 701/2
2013/0060524 A1 3/2013 Liao
2013/0124028 A1 * 5/2013 Ang ..... B60L 11/1851 701/22
2013/0261856 A1 * 10/2013 Sharma ..... B61L 25/025 701/19
2013/0268172 A1 10/2013 Nandedkar et al.
2013/0325258 A1 * 12/2013 Cooper ..... B60T 7/18 701/36
2014/0032023 A1 * 1/2014 Kumar ..... B60T 17/228 701/20
2014/0129060 A1 * 5/2014 Cooper ..... B61L 15/0027 701/19
2015/0203117 A1 * 7/2015 Kelly ..... B60K 31/02 701/91
2016/0129925 A1 * 5/2016 Jensen ..... B61C 17/12 701/19
2016/0257323 A1 * 9/2016 Meyer ..... B61L 27/0016

OTHER PUBLICATIONS

Office Action for corresponding EA Application No. 201791663/31 dated Mar. 12, 2019 in Russian (3 pages).
English Translation of the Office Action for corresponding EA Application No. 201791663/31 dated Mar. 12, 2019 (3 pages).
Examination Report for corresponding AU Application No. 2018201604 dated Mar. 13, 2019 (3 pages).

* cited by examiner

SYSTEM AND METHOD FOR CONTROLLING A VEHICLE SYSTEM

CROSS-REFERENCE TO RELATED APPLICATIONS

This application is a continuation of, and claims priority to, U.S. patent application Ser. No. 15/058,772 filed Mar. 2, 2016, which in turn claims priority to U.S. Provisional Application No. 62/128,290, filed Mar. 4, 2015, both of which are incorporated by reference in their entireties.

FIELD

Embodiments of the subject matter described herein relate to a method and system for controlling a vehicle system traveling on a route.

BACKGROUND

Vehicle systems that travel on routes may travel on defined trips from starting or departure locations to destination or arrival locations. Each trip may extend along the route for long distances, and the trip may include one or more designated stops along the trip prior to reaching the arrival location, such as for a crew change, refueling, picking up or dropping off passengers and/or cargo, and the like. Some vehicle systems travel according to trip plans that provide instructions for the vehicle system to implement during movement of the vehicle system such that the vehicle system meets or achieves certain objectives during the trip. The objectives for the trip may include reaching the arrival location at or before a predefined arrival time, increasing fuel efficiency (relative to the fuel efficiency of the vehicle system traveling without following the trip plan), abiding by speed limits and emissions limits, and the like. The trip plans may be generated to achieve the specific objectives, so the instructions provided by the trip plans are based on those specific objectives.

Traveling according to trip plans can provide various benefits, such as fuel economy, as long as the objectives of the trip plan are relevant to the operations of the vehicle system. For example, the objective of increasing fuel efficiency is beneficial to the vehicle system as the vehicle system travels along an open section of the route at a planned running speed, but the same trip plan is not as beneficial if the section of the route has maintenance, congestion, or other constraints that limit the speed of the vehicle system to a speed below the planned running speed. In another example, the objective of increasing fuel economy is also not relevant near the designated stop locations (including the arrival location) along the route because the vehicle system has to travel at slow speeds to stop at the stop locations. Due to these issues, some operators of the vehicle system may choose to not follow the trip plan.

SUMMARY

In one embodiment, a system (e.g., a control system for controlling a vehicle system along a route) includes a sensor and a controller that includes one or more processors. The sensor is configured to monitor an operating condition of the vehicle system during movement of the vehicle system along the route for a trip. The controller is configured to designate one or more operational settings for the vehicle system as a function of one or more of time or distance along the route. The one or more operational settings are designated to drive the vehicle system toward achievement of one or more objectives for the trip. The controller is operable in at least two operating modes including a first operating mode and a second operating mode. The controller operates in the first operating mode responsive to the operating condition of the vehicle system being at least one of at or above a designated threshold. The controller in the first operating mode is configured to designate operational settings to drive the vehicle system during the trip toward achievement of a first objective during movement of the vehicle system along the route. The first objective includes one or more of a reduction in fuel consumption or a reduction in emissions generation by the vehicle system relative to the vehicle system traveling along the route for the trip according to operational settings that differ from the one or more operational settings designated by the controller. The controller operates in the second operating mode responsive to the operating condition of the vehicle system being below the designated threshold. The controller in the second operating mode is configured to designate operational settings to drive the vehicle system during the trip toward achievement of a different, second objective during movement of the vehicle system along the route.

In another embodiment, a method (e.g., for controlling a vehicle system along a route) includes generating a trip plan for a trip of the vehicle system along the route. The trip plan designates one or more operational settings for the vehicle system as a function of one or more of time or distance along the route. The one or more operational settings are designated to drive the vehicle system toward achievement of one or more objectives of the trip plan. The trip plan is generated to drive the vehicle system during the trip toward achievement of a first objective responsive to movement of the vehicle system along the route at a speed that is at least as fast as a designated threshold speed. The trip plan is generated to drive the vehicle system during the trip toward achievement of a different, second objective responsive to movement of the vehicle system along the route at a speed that is slower than the designated threshold speed.

DETAILED DESCRIPTION

Figure 1:
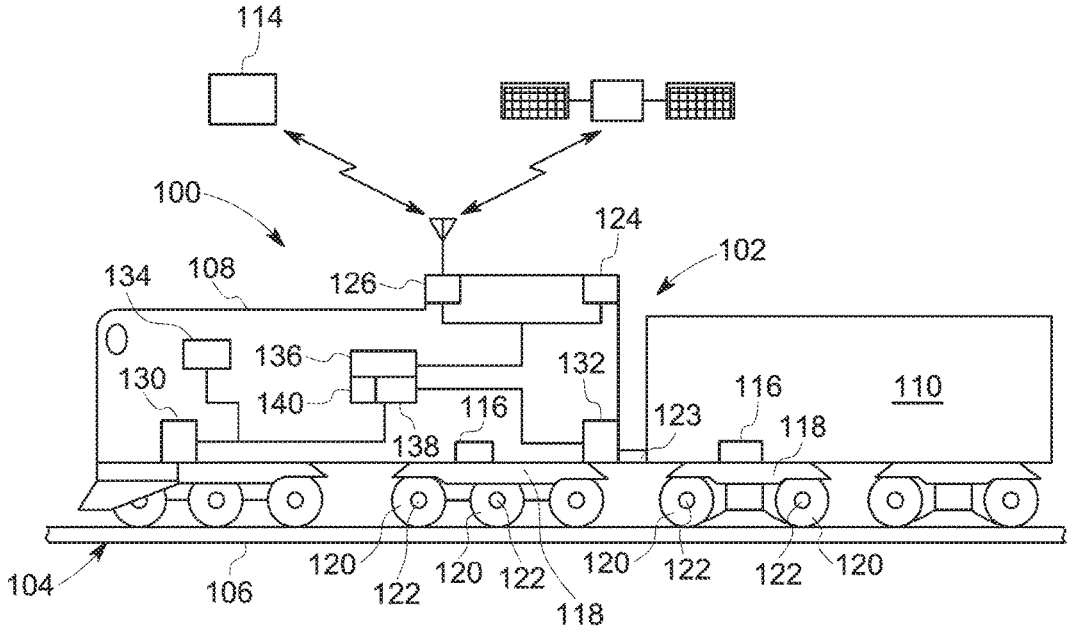
FIG. 1 is a schematic diagram of one embodiment of a control system disposed onboard a vehicle system.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "module," "system," "device," or "unit," may include a hardware and/or software system and circuitry that operate to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

Embodiments of the subject matter disclosed herein describe methods and systems used in conjunction with controlling a vehicle system that travels on a route. The embodiments provide methods and systems for controlling the vehicle system along the route in order to achieve different objectives based on different operating conditions of the vehicle system.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, components represented by multiple functional blocks (for example, processors, controllers, or memories) may be implemented in a single piece of hardware (for example, a general purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

FIG. 1 illustrates a schematic diagram of a control system 100 according to an embodiment. The control system 100 is disposed on a vehicle system 102. The vehicle system 102 is configured to travel on a route 104. The vehicle system 102 is configured to travel along the route 104 on a trip from a starting or departure location to a destination or arrival location. The vehicle system 102 includes a propulsion-generating vehicle 108 and a non-propulsion-generating vehicle 110 that are mechanically interconnected to one another in order to travel together along the route 104. Alternatively, the vehicle system 102 may be formed from a single vehicle 108.

The propulsion-generating vehicle 108 is configured to generate tractive efforts to propel (for example, pull or push) the non-propulsion-generating vehicle 110 along the route 104. The propulsion-generating vehicle 108 includes a propulsion subsystem, including one or more traction motors, that generates tractive effort to propel the vehicle system 102. The propulsion-generating vehicle 108 also includes a braking subsystem that generates braking effort for the vehicle system 102 to slow down or stop itself from moving. Optionally, the non-propulsion-generating vehicle 110 includes a braking subsystem but not a propulsion subsystem. The propulsion-generating vehicle 108 is referred to herein as a propulsion vehicle 108, and the non-propulsion-generating vehicle 110 is referred to herein as a car 110. Although one propulsion vehicle 108 and one car 110 are shown in FIG. 1, the vehicle system 102 may include multiple propulsion vehicles 108 and/or multiple cars 110. In an alternative embodiment, the vehicle system 102 only includes the propulsion vehicle 108 such that the propulsion vehicle 108 is not coupled to the car 110 or another kind of vehicle.

The control system 100 is used to control the movements of the vehicle system 102. In the illustrated embodiment, the control system 100 is disposed entirely on the propulsion vehicle 108. In other embodiments, however, one or more components of the control system 100 may be distributed among several vehicles, such as the vehicles 108, 110 that make up the vehicle system 102. For example, some components may be distributed among two or more propulsion vehicles 108 that are coupled together in a group or consist. In an alternative embodiment, at least some of the components of the control system 100 may be located remotely from the vehicle system 102, such as at a dispatch location 114. The remote components of the control system 100 may communicate with the vehicle system 102 (and with components of the control system 100 disposed thereon).

In the illustrated embodiment, the vehicle system 102 is a rail vehicle system, and the route 104 is a track formed by one or more rails 106. The propulsion vehicle 108 may be a locomotive, and the car 110 may be a rail car that carries passengers and/or cargo. Alternatively, the propulsion vehicle 108 may be another type of rail vehicle other than a locomotive. In an alternative embodiment, the vehicle system 102 may be a non-rail vehicle system, such as an off-highway vehicle (OHV) system (e.g., a vehicle system that is not legally permitted and/or designed for travel on public roadways), an automobile, or the like. While some examples provided herein describe the route 104 as being a track, not all embodiments are limited to a rail vehicle traveling on a railroad track. One or more embodiments may be used in connection with non-rail vehicles and routes other than tracks, such as roads, waterways, or the like.

The vehicles 108, 110 of the vehicle system 102 each include multiple wheels 120 that engage the route 104 and at least one axle 122 that couples left and right wheels 120 together (only the left wheels 120 are shown in FIG. 1). Optionally, the wheels 120 and axles 122 are located on one or more trucks or bogies 118. Optionally, the trucks 118 may be fixed-axle trucks, such that the wheels 120 are rotationally fixed to the axles 122, so the left wheel 120 rotates the same speed, amount, and at the same times as the right wheel 120. The propulsion vehicle 108 is mechanically coupled to the car 110 by a coupler 123. The coupler 123 may have a draft gear configured to absorb compression and tension forces to reduce slack between the vehicles 108, 110. Although not shown in FIG. 1, the propulsion vehicle 108 may have a coupler located at a front end 125 of the propulsion vehicle 108 and/or the car 110 may have a coupler located at a rear end 127 of the car 110 for mechanically coupling the respective vehicles 108, 110 to additional vehicles in the vehicle system 102.

As the vehicle system 102 travels along the route 104 during a trip, the control system 100 may be configured to measure, record, or otherwise receive and collect input information about the route 104, the vehicle system 102, and the movement of the vehicle system 102 on the route 104. For example, the control system 100 may be configured to monitor a location of the vehicle system 102 along the route 104 and a speed at which the vehicle system 102 moves along the route 104. In addition, the control system 100 may be configured to generate a trip plan and/or a control signal based on such information. The trip plan and/or control signal designates one or more operational settings for the vehicle system 102 to implement or execute during the trip as a function of time and/or location along the route 104. The operational settings may include tractive and braking efforts for the vehicle system 102. For example, the operational settings may include dictated speeds, throttle settings, brake settings, accelerations, or the like, of the vehicle system 102 as a function of time and/or distance along the route 104 traversed by the vehicle system 102.

The trip plan is configured to achieve or increase specific goals or objectives during the trip of the vehicle system 102, while meeting or abiding by designated constraints, restrictions, and limitations. Some possible objectives include increasing energy (e.g., fuel) efficiency, reducing emissions generation, reducing trip duration, increasing fine motor control, reducing wheel and route wear, and the like. The constraints or limitations include speed limits, schedules (such as arrival times at various designated locations), environmental regulations, standards, and the like. The operational settings of the trip plan are configured to increase the level of attainment of the specified objectives relative to the vehicle system 102 traveling along the route 104 for the trip according to operational settings that differ from the one or more operational settings of the trip plan (e.g., such as if the human operator of the vehicle system 102 determines the tractive and brake settings for the trip). One example of an objective of the trip plan is to increase fuel efficiency (e.g., by reducing fuel consumption) during the trip. By implementing the operational settings designated by the trip plan, the fuel consumed may be reduced relative to travel of the same vehicle system along the same segment of the route in the same time period but not according to the trip plan.

The trip plan may be established using an algorithm based on models for vehicle behavior for the vehicle system 102 along the route. The algorithm may include a series of non-linear differential equations derived from applicable physics equations with simplifying assumptions, such as described in connection with U.S. patent application Ser. No. 12/955,710, U.S. Pat. No. 8,655,516, entitled "Communication System for a Rail Vehicle Consist and Method for Communicating with a Rail Vehicle Consist," which was filed 29 Nov. 2010 (the "'516 patent"), the entire disclosure of which is incorporated herein by reference.

Some known trip plans may not include multiple objectives that change based on conditions of the vehicle system. Since a trip plan with an objective of fuel efficiency may not be relevant as a vehicle system slows to a stop while approaching a designated stop location along the route, the trip plan may not be beneficial to an operator of the vehicle system while approaching and navigating the stop location at slow speeds. The trip plan may not be generated with an objective of fine motor control, so following instructions of the trip plan as the vehicle system approaches a stop location and exits the stop location may cause the vehicle system to stop and start abruptly, may cause the vehicle system to stop at an undesired or imprecise location relative to a desired stop location, and/or may cause wheel and/or track wear due to wheel slippage, for example.

In an embodiment, the control system 100 is configured to generate multiple trip plans for the vehicle system 102 to follow along the route 104 during the trip. The multiple trip plans may have different objectives from one another. The difference in objectives may be based on operating conditions of the vehicle system 102. The operating conditions may be a speed of the vehicle system 102, a location of the vehicle system 102 along the route, or the like. For example, the vehicle system 102 may move according to a first trip plan responsive to the vehicle system 102 is traveling at a speed that is at and/or above a designated threshold speed, and the vehicle system 102 may move according to a different, second trip plan responsive to the vehicle system 102 is traveling at a speed below the designated threshold speed. Both the first and second trip plans may be generated by the control system 100 prior to the vehicle system 102 embarking on the trip. Alternatively, only the first trip plan is generated prior to the trip, and the second trip plan is generated during the trip of the vehicle system 102 in response to the operating condition of the vehicle system 102 crossing the designated threshold. For example, the second trip plan may be a modified trip plan or a trip re-plan that modifies or updates the previously-generated first trip plan to account for the changing objectives.

In an alternative embodiment, instead of generating multiple different trip plans, the control system 100 may be configured to generate a single trip plan that accounts for changing objectives of the vehicle system 102 along the route 104. For example, the trip plan may constructively divide the trip into multiple segments based on time, location, or a projected speed of the vehicle system along the route. In some of the segments, the operational settings of the trip plan are designated to drive the vehicle system 102 toward achievement of at least a first objective. In at least one other segment, the operational settings of the trip plan are designated to drive the vehicle system 102 toward achievement of at least a different, second objective.

The control system 100 may be configured to control the vehicle system 102 along the trip based on the trip plan, such that the vehicle system 102 travels according to the trip plan. In a closed loop mode or configuration, the control system 100 may autonomously control or implement propulsion and braking subsystems of the vehicle system 102 consistent with the trip plan, without requiring the input of a human operator. In an open loop coaching mode, the operator is involved in the control of the vehicle system 102 according to the trip plan. For example, the control system 100 may present or display the operational settings of the trip plan to the operator as directions on how to control the vehicle system 102 to follow the trip plan. The operator may then control the vehicle system 102 in response to the directions. As an example, the control system 100 may be or include a Trip Optimizer™ system from General Electric Company, or another energy management system. For additional discussion regarding a trip plan, see the '516 patent.

The control system 100 includes multiple sensors configured to monitor operating conditions of the vehicle system 102 during movement of the vehicle system 102 along the route 104 during for a trip. The multiple sensors may monitor data that is communicated to a controller 136 of the control system 100 for processing and analysis of the data. For example, the controller 136 may generate a trip plan based on the data received from one or more of the sensors. One such type of sensor is a speed sensor 116 disposed on the vehicle system 102. In the illustrated embodiment, multiple speed sensors 116 are located on or near the trucks 118. The speed sensor 116 is configured to monitor a speed of the vehicle system 102 as the vehicle system 102 traverses the route 104. The speed sensor 116 may be a speedometer, a vehicle speed sensor (VSS), or the like. The speed sensor 116 may provide a speed parameter to the controller 136, where the speed parameter is associated with a current speed of the vehicle system 102. The speed parameter may be communicated to the controller 136 periodically, such as once every second or every two seconds, or upon receiving a request for the speed parameter.

Another sensor of the control system 100 is a locator device 124. The locator device 124 is configured to determine a location of the vehicle system 102 on the route 104. The locator device 124 may be a global positioning system (GPS) receiver. Alternatively, the locator device 124 may include a system of sensors including wayside devices (e.g., including radio frequency automatic equipment identification (RF AEI) tags), video or image acquisition devices, or the like. The locator device 124 may provide a location parameter to the controller 136, where the location parameter is associated with a current location of the vehicle system 102. The location parameter may be communicated to the controller 136 periodically or upon receiving a request for the speed parameter. The controller 136 may use the location of the vehicle system 102 to determine the proximity of the vehicle system 102 to one or more designated locations of the trip. For example, the designated locations may include an arrival location at the end of the trip, a passing loop location along the route 104 where another vehicle system on the route 104 is scheduled to pass the vehicle system 102, a break location for re-fueling, crew change, passenger change, or cargo change, and the like.

The control system 100 also includes additional sensors 132 that measure other operating conditions or parameters of the vehicle system 102 during the trip (e.g., besides speed and location). The additional sensors 132 may include throttle and brake position sensors that monitor the positions of manually-operated throttle and brake controls, respectively, and communicate control signals to the respective propulsion and braking subsystems. The sensors 132 may also include sensors that monitor power output by the motors of the propulsion subsystem and the brakes of the braking subsystem to determine the current tractive and braking efforts of the vehicle system 102. Furthermore, the control system 100 may include string potentiometers (referred to herein as string pots) between at least some of the vehicles 108, 110 of the vehicle system 102, such as on or proximate to the couplers 123. The string pots may monitor a relative distance and/or a longitudinal force between two vehicles. For example, the couplers 123 between two vehicles may allow for some free movement or slack of one of the vehicles before the force is exerted on the other vehicle. As the one vehicle moves, longitudinal compression and tension forces shorten and lengthen the distance between the two vehicles like a spring. The string pots are used to monitor the slack between the vehicles of the vehicle system 102. The above represents a short list of possible sensors that may be on the vehicle system 102 and used by the control system 100, and it is recognized that the vehicle system 102 and/or the control system 100 may include more sensors, fewer sensors, and/or different sensors.

The control system 100 may further include a wireless communication system 126 that allows wireless communications between vehicles 108, 110 in the vehicle system 102 and/or with remote locations, such as the remote (dispatch) location 114. The communication system 126 may include a receiver and a transmitter, or a transceiver that performs both receiving and transmitting functions. The communication system 126 may include an antenna and associated circuitry.

In an embodiment, the control system 100 includes a vehicle characterization element 134 that provides information about the vehicle system 102. The vehicle characterization element 134 provides information about the make-up of the vehicle system 102, such as the type of cars 110 (for example, the manufacturer, the product number, the materials, etc.), the number of cars 110, the weight of cars 110, whether the cars 110 are consistent (meaning relatively identical in weight and distribution throughout the length of the vehicle system 102) or inconsistent, the type and weight of cargo, the total weight of the vehicle system 102, the number of propulsion vehicles 108, the position and arrangement of propulsion vehicles 108 relative to the cars 110, the type of propulsion vehicles 108 (including the manufacturer, the product number, power output capabilities, available notch settings, fuel usage rates, etc.), and the like. The vehicle characterization element 134 may be a database stored in an electronic storage device, or memory. The information in the vehicle characterization element 134 may be input using an input/output (I/O) device (referred to as a user interface device) by an operator, may be automatically uploaded, or may be received remotely via the communication system 126. The source for at least some of the information in the vehicle characterization element 134 may be a vehicle manifest, a log, or the like.

The control system 100 further includes a trip characterization element 130. The trip characterization element 130 is configured to provide information about the trip of the vehicle system 102 along the route 104. The trip information may include route characteristics, designated locations, designated stopping locations, schedule times, meet-up events, directions along the route 104, and the like. For example, the designated route characteristics may include grade, elevation slow warnings, environmental conditions (e.g., rain and snow), and curvature information. The designated locations may include the locations of wayside devices, passing loops, re-fueling stations, passenger, crew, and/or cargo changing stations, and the starting and destination locations for the trip. At least some of the designated locations may be designated stopping locations where the vehicle system 102 is scheduled to come to a complete stop for a period of time. For example, a passenger changing station may be a designated stopping location, while a wayside device may be a designated location that is not a stopping location. The wayside device may be used to check on the on-time status of the vehicle system 102 by comparing the actual time at which the vehicle system 102 passes the designated wayside device along the route 104 to a projected time for the vehicle system 102 to pass the wayside device according to the trip plan. The trip information concerning schedule times may include departure times and arrival times for the overall trip, times for reaching designated locations, and/or arrival times, break times (e.g., the time that the vehicle system 102 is stopped), and departure times at various designated stopping locations during the trip. The meet-up events include locations of passing loops and timing information for passing, or getting passed by, another vehicle system on the same route. The directions along the route 104 are directions used to traverse the route 104 to reach the destination or arrival location. The directions may be updated to provide a path around a congested area or a construction or maintenance area of the route. The trip characterization element 130 may be a database stored in an electronic storage device, or memory. The information in the trip characterization element 130 may be input via the user interface device by an operator, may be automatically uploaded, or may be received remotely via the communication system 126. The source for at least some of the information in the trip characterization element 130 may be a trip manifest, a log, or the like.

The control system 100 has a controller 136 or control unit that is a hardware and/or software system which operates to perform one or more functions for the vehicle system 102. The controller 136 receives information from components of the control system 100, analyzes the received information, and generates operational settings for the vehicle system 102 to control the movements of the vehicle system 102. The operational settings may be contained in a trip plan. The controller 136 has access to, or receives information from, the speed sensor 116, the locator device 124, the vehicle characterization element 134, the trip characterization element 130, and at least some of the other sensors 132 on the vehicle system 102. The controller 136 may be a device that includes a housing and one or more processors 138 therein (e.g., within a housing). Each processor 138 may include a microprocessor or equivalent control circuitry. At least one algorithm operates within the one or more processors 138. For example, the one or more processors 138 may operate according to one or more algorithms to generate a trip plan.

The controller 136 optionally may also include a controller memory 140, which is an electronic, computer-readable storage device or medium. The controller memory 140 may be housed in the housing of the controller 136, or alternatively may be on a separate device that is communicatively coupled to the controller 136 and the one or more processors 138 therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The controller memory 140 can include a tangible, non-transitory computer-readable storage medium that stores data on a temporary or permanent basis for use by the one or more processors 138. The memory 140 may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

In an embodiment, using the information received from the speed sensor 116, the locator device 124, the vehicle characterization element 134, and trip characterization element 130, the controller 136 is configured to designate one or more operational settings for the vehicle system 102 as a function of time and/or distance along the route 104 during a trip. The one or more operational settings are designated to drive or control the movements of the vehicle system 102 during the trip toward achievement of one or more objectives for the trip. In an embodiment, the controller 136 is operable in at least two operating modes in order to accommodate different objectives for different portions of the trip. For example, the controller 136 in a first operating mode is configured to designate operational settings to drive the vehicle system 102 toward achievement of at least a first objective. The controller 136 in a second operating mode, on the other hand, is configured to designate operational settings to drive the vehicle system 102 toward achievement of at least a different, second objective. The controller 136 in an embodiment is configured to switch between the first and second operating mode when an operating condition of the vehicle system 102 crosses a designated threshold, as described further below with reference to FIGS. 2 and 3.

The operational settings may be one or more of speeds, throttle settings, brake settings, or accelerations for the vehicle system 102 to implement during the trip. Optionally, the controller 136 may be configured to communicate at least some of the operational settings designated by the controller 136 in a control signal. The control signal may be directed to the propulsion subsystem, the braking subsystem, or a user interface device of the vehicle system 102. For example, the control signal may be directed to the propulsion subsystem and may include notch throttle settings of a traction motor for the propulsion subsystem to implement autonomously upon receipt of the control signal. In another example, the control signal may be directed to a user interface device that displays and/or otherwise presents information to a human operator of the vehicle system 102. The control signal to the user interface device may include throttle settings for a throttle that controls the propulsion subsystem, for example. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

Figure 2:
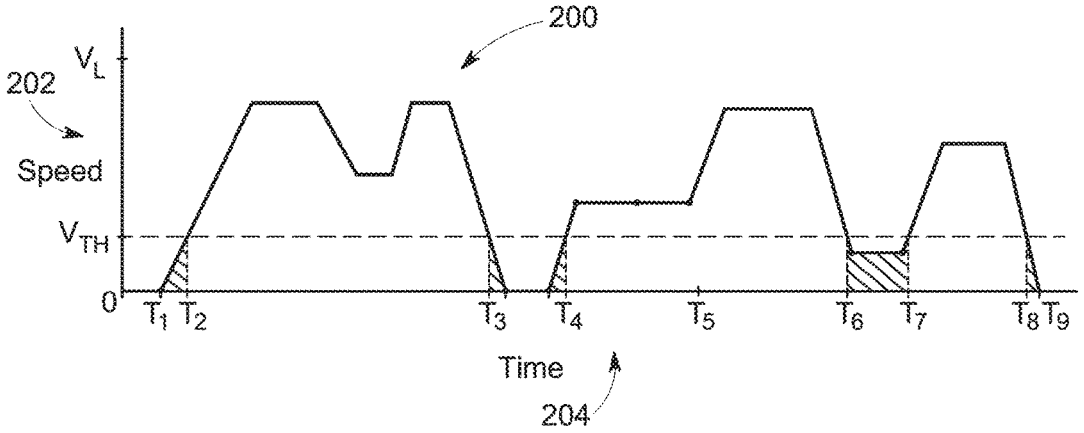
FIG. 2 is a schematic diagram showing a speed profile of the vehicle system traveling on a route during a trip according to one embodiment.

FIG. 2 is a schematic diagram showing a speed profile 200 of the vehicle system 102 (shown in FIG. 1) traveling on the route 104 (FIG. 1) during a trip according to an embodiment. The speed profile 200 plots a speed 202 or velocity of the vehicle system 102 over time 204 during the trip. The speed profile 200 of the vehicle system 102 may travel according to a trip plan (e.g., operational settings designated by the trip plan) generated by the controller 136 (FIG. 1) of the control system 100 (FIG. 1).

As stated above, the controller 136 may switch between a first and second operating mode when an operating condition of the vehicle system 102 crosses a designated threshold. In the illustrated embodiment, the operating condition that is used to determine the operating mode of the controller 136 is a speed of the vehicle system 102 along the route. The designated threshold is a threshold speed (shown in FIG. 2 as $V_{TH}$). In an embodiment, the controller 136 may operate in a first operating mode based on or responsive to the speed of the vehicle system 102 being at least at or above the threshold speed, and the controller 136 may operate in the second operating mode based on or responsive to the speed of the vehicle system 102 falling below the threshold speed.

During the trip, as shown in the speed profile 200, the speed of the vehicle system 102 may cross the threshold speed multiple times. For example, the vehicle system 102 travels faster than the threshold speed during a majority of the trip. The controller 136 thus operates in the first operating mode for the majority of the duration of the trip. Yet, when the vehicle system 102 starts on the trip or otherwise accelerates from a stopped position, the speed of the vehicle system 102 is at least temporarily below the threshold speed. Likewise, the speed of the vehicle system 102 is below the threshold speed when the vehicle system 102 slows to a stop at the end of the trip or at another designated stopping location along the route 104. Thus, the controller 136 operates in the second operating mode at least at the times when the vehicle system 102 is slowing to a stop or accelerating from a stop.

In an embodiment, the objectives for the movement of the vehicle system 102 change responsive to a change in the operating mode of the controller 136. In the first operating mode, when the vehicle system 102 travels faster than the threshold speed, the controller 136 designates operational settings to drive the vehicle system 102 to achieve a first objective. The first objective may be one or more of a reduction in fuel consumption by the vehicle system 102, a reduction in emissions generation by the vehicle system 102, improved handling of the vehicle system 102, or a reduction in travel time during the trip. The first objective may include multiple objectives, such as more than one of the objective listed above. The reduction in fuel consumption, emissions generation, and/or travel time, and the improvement in handling achieved by implementing the designated operational settings is relative to the vehicle system 102 traveling along the route for the trip according to operational settings that differ from the operational settings designated by the controller 136. For example, the operational settings designated by the controller 136 may produce a driving strategy with less drag loss and/or less braking loss compared to a driving strategy determined by a human operator.

The controller 136 may be configured to designate the operational settings to drive the vehicle system 102 toward achievement of the first objective while satisfying one or more constraints. For example, the constraints may include speed limits along the route 104, vehicle capability constraints, trip schedule times, emissions limits, and the like. Thus, as the vehicle system 102 implements the designated operational settings, the vehicle system 102 does not exceed the specified constraints for the relevant segment of the route 104. For example, the speed limits may be permanent or temporary speed limits set by the railroad or highway authority. The temporary speed limits may be due to construction, maintenance, or congestion on the route 104. The vehicle capability constraints may include power output capabilities of the motors of the propulsion vehicle 108 (FIG. 1), notch settings of the propulsion vehicle 108, and/or available fuel supply on the vehicle system. Thus, the controller 136 is configured to not designate operational settings that require the propulsion vehicle 108 to provide more power than the propulsion vehicle 108 can reasonably supply. The trip schedule times include designated times for the trip, such as the projected arrival time at the destination location, scheduled meet-up times, and times that the vehicle system 102 should reach designated route markers, such as wayside devices and/or stopping locations. The emissions limits may include limitations on fuel emissions, noise emissions, and the like, as designated by the Environmental Protection Agency (EPA), railroad companies, municipalities, and other regulatory authorities. Some of the constraints may be determined using information from the vehicle characterization element 134 (such as vehicle capability limitations) and information from the trip characterization element 130 (such as speed limits and schedule times). Other constraints may be determined using information received from a remote source via the wireless communication system 126.

In an embodiment, the first objective may be to reduce fuel consumption by the vehicle system 102 along the length of the route 104 subject to the above constraints, such as emissions limits and speed limits. In another embodiment, the first objective may be to reduce emissions generated by the vehicle system 102, subject to constraints such as fuel use and/or scheduled arrival time. In yet another example, the first objective may be to reduce the travel time without constraints on total emissions generated and/or fuel consumed where such relaxation of constraints would be permitted or required for the trip. The reduction in travel time may refer to a reduction in total travel time during the trip between the departure location and the destination location, and/or may refer to travel time along segments of the trip. Optionally, the first objective may include more than a single objective, such that the first objective includes both reducing fuel consumption and emissions generation of the vehicle system 102 along the route 104 subject to constraints such as speed limits, vehicle capability constraints, and trip schedule times.

The handling of the vehicle system 102 may involve controlling the forces exerted within the couplers between individual vehicles of the vehicle system 102. For example, prospective forces that are expected or calculated as being exerted on and/or experienced by couplers in the vehicle system may be reduced by limiting the allowable speeds of the vehicle system. The allowable speeds may be limited to speeds that are slower than speed dictated by a trip plan of the vehicle system 102, speed limits of the route, or the like. The handling of the vehicle system 102 can be improved in that the coupler forces between vehicles are reduced relative to vehicle systems that travel along the same routes without limiting the allowable speeds of the vehicle systems. The allowable speeds of the vehicle system 102 may be restricted in those locations or segments of the route where the larger prospective forces on the couplers are expected to occur, while the allowable speeds of the vehicle system 102 may not be restricted in other locations. As a result, the vehicle system 102 may be able to travel at or near the designated speeds of a trip plan, the speed limits of the route, or the like, for most of a trip such that the vehicle system 102 can remain on schedule or complete the trip in a time period closer to the time period contemplated by the trip plan and/or speed limits of the route. The vehicle handling may also include controlling the spacing between individual vehicles in the vehicle system. For example, the vehicle system 102 may be controlled to manage the tension and compression in the couplers to maintain the forces within acceptable designated limits, which also affects the spacing between vehicles.

Once the first objective is identified, the controller 136 may generate the operational settings for the vehicle system 102 for a segment of the route 104 subject to applicable constraints. The operational settings may be contained in a trip plan that is generated by the controller 136. As described above, the controller 136 receives relevant information about the trip, the vehicle system 102, and the route 104. The controller 136 may generate a trip plan using an algorithm based on models for vehicle behavior for the vehicle system 102 along the route 104. The algorithm may include a series of non-linear differential equations derived from applicable physics equations with simplifying assumptions, such as described in connection with the '516 patent. For example, for a first objective of reducing fuel consumption, the controller 136 may consult a plotted fuel-use over travel time curve that has been created using data from previous trips of different vehicle systems over the route at different speeds. The generated trip plan designates operational settings for the vehicle system 102 as a function of time and/or distance along the route 104. The operational settings are designated to drive the vehicle system 102 toward achievement of the first objective. Thus, responsive to the vehicle system 102 is traveling at or above the threshold speed, the controller 136 is in the first operating mode. In the first operating mode, the controller 136 designates operational settings, according to a trip plan, in order to drive the vehicle system 102 toward achievement of the first objective, which includes reducing fuel consumption, reducing emissions generation, improving vehicle handling, and/or reducing total travel time.

In an embodiment, the threshold speed is a speed that is selected prior to the trip of the vehicle system 102. For example, the threshold speed may be a speed between 3 miles per hour (mph) (4.5 kph) and 20 mph (33 kph), or, more specifically, between 5 mph (8 kph) and 15 mph (25 kph). The threshold speed could be 5 mph, 10 mph, or 15 mph in various embodiments. The threshold speed may depend on the type of vehicle system 102. For example, the threshold speed for a vehicle system 102 that is a rail vehicle may be lower than a threshold speed for a vehicle system 102 that is an off-highway vehicle, and may be higher than a threshold speed for a vehicle system 102 that is a water vessel.

In an embodiment, based on or responsive to the operating condition of the vehicle system 102 falling below the designated threshold, the operating mode of the controller 136 changes as well as the objectives for the movement of the vehicle system 102. For example, when the speed of the vehicle system 102 is below the threshold speed, the controller 136 operates in the second operating mode. In the second operating mode, the controller 136 designates operational settings to drive the vehicle system 102 to achieve a second objective that differs from the first objective. In one embodiment, the operating mode of the controller 136 and the objective of the movement of the vehicle system 102 change automatically upon the operating condition of the vehicle system 102 crossing the threshold. For example, even if the speed of the vehicle system 102 coincidentally or unintentionally falls below the designated speed threshold, the switch in operating mode of the controller 136 and objective of the movement of the vehicle system 102 is triggered. Alternatively, the switch in the operating mode and the movement objectives may occur based on the operating condition crossing the threshold, but not automatically. For example, upon detecting that the operating condition has crossed the designated threshold, the controller 136 may provide a notification to an on-board human operator, requesting or suggesting the change in operating conditions of the controller 136 and the change in movement objectives of the vehicle system 102. Thus, the human operator may have the option and final authority on whether to proceed with the change or not.

The operating mode of the controller 136 changes based on the operating condition of the vehicle system 102 to switch objectives for the movement of the vehicle system 102 because the relevancy or priority of objectives may change with changing circumstances or conditions of the vehicle system 102 along the route 104. For example, when the vehicle system 102 is traveling at speeds over the threshold speed, the relevant objectives may be reducing fuel consumption, reducing emissions generation, and/or reducing total travel time for the trip. These objectives are relevant at speeds over the threshold speed as the vehicle system 102 may traverse a majority of the distance of the route 104 at such speeds. On the other hand, the vehicle system 102 may move at speeds below the threshold speed when the vehicle system 102 is slowing to a stop or accelerating from a stop, for example. At these conditions or circumstances, the fuel efficiency of the vehicle system 102 may not be as high of a priority as other objectives, such fine motor control. Thus, fine motor control of the vehicle system 102 may be more relevant than fuel efficiency at speeds of the vehicle system 102 below the threshold speed. For this reason, the controller 136 changes operating modes from the first operating mode to the second operating mode when the speed of the vehicle system 102 falls below the threshold speed in order to designate operational settings that drive the vehicle system 102 toward achievement of a different, second objective that is more relevant to the vehicle system 102 at that speed than the first objective.

In an embodiment, the second objective relates to fine control over the vehicle system 102, which is useful for controlling the vehicle system 102 at slow speeds. Fine motor control may be beneficial as the vehicle system 102 approaches, reaches, and departs designated stopping locations. For example, the second objective may include moving the vehicle system 102 to one or more locations that are within a designated threshold distance of one or more designated locations of the trip.

The designated locations may include stopping locations (such as the destination location or a break location) designated in the trip schedule. For example, as the vehicle system 102 approaches a station in order to change personnel and/or passengers, the station may have designated markers that indicate where the vehicle system 102 is to come to a stop. The station may be relatively long, such that some vehicle systems are designated to stop at different locations than other vehicle systems in order to pick up or drop off the appropriate passengers and/or personnel. The markers may indicate where the propulsion vehicle 108 of the vehicle system 102 is to stop. Since it is recognized that vehicle systems may not be able to stop exactly at a designated marker at a stopping location, the station and/or the transit authority may request that the vehicle system 102 stop within a designated threshold distance, before or after, the marker. In an embodiment, the second objective may be to stop the vehicle system 102 at a location that is within the designated threshold distance of the designated stopping location of the trip. To accomplish the second objective, the controller 136 may designate operational settings for the vehicle system 102 to implement in order to practice fine motor control over the vehicle system 102. For example, the operational settings may include slight adjustments to tractive efforts of the traction motors of the propulsion subsystem and slight adjustments to braking efforts of the braking subsystem to accomplish stopping the vehicle system 102 within the designated threshold distance from a designated stopping location.

The operational settings designated by the controller 136 (e.g., according to a trip plan) may allow the vehicle system 102 to stop within a closer proximity to the designated stopping location than if the vehicle system 102 was being controlled solely by a human operator. In addition, the operational settings designated by the controller 136 to drive the vehicle system 102 toward achievement of the second objective may allow the vehicle system 102 to stop within a closer proximity to the designated stopping location than if the operational settings were designated to drive the vehicle system 102 toward achievement of the first objective. For example, the fine motor control required in order to stop the vehicle system 102 at such a close proximity to the designated stopping location may not have been attainable if the vehicle system 102 is driven to achieve a different objective, such as fuel economy. The fine motor controls to drive the vehicle system 102 toward achievement of the second objective may consume more fuel, generate more emissions, and/or take a longer amount of time to stop the vehicle system 102 than if the vehicle system 102 were being driven toward achievement of the first objective. However, as the vehicle system 102 is approaching a stop, such as a station, the fuel consumption, emissions generation, and/or time of travel may not be as high of a priority as making sure that the vehicle system 102 stops accurately within a threshold distance of a designated stopping location.

In another example, the second objective includes stopping the vehicle system 102 such that multiple vehicles of the vehicle system 102 are bunched together with one or more couplers disposed between the vehicles in a slack state (for example, a state of having slack) once the vehicle system 102 is stopped. As shown in FIG. 1, the vehicles 108, 110 of the vehicle system 102 are coupled together by coupler devices 123. The couplers 123 are configured to absorb longitudinal forces between the vehicles of the vehicle system 102 (such as the vehicles 108, 110). As the vehicle system 102 moves, longitudinal compression and tension forces shorten and lengthen the distance between the two vehicles. The couplers 123 may be configured to allow for some free movement or slack of a first vehicle before the force is exerted on a second vehicle that is coupled to the first vehicle. When the coupler 123 between two vehicles is not under tension (or the tension in the coupler has a magnitude below a designated threshold), the coupler 123 may be referred to as being in a slack state or slack condition. The slack state is in comparison to a stretch state of the coupler when the tension in the coupler has a magnitude greater than a designated threshold. It may be desirable in some situations for the couplers of a vehicle system to be in the slack state when the vehicle system is stopped because, when the vehicle system starts moving again, the propulsion vehicles do not have to pull the entire load of the vehicle system from the stationary position at the same time. Instead, due to the accumulation of slack between the vehicles (also referred to as bunching), each propulsion vehicle originally pulls a first car until the slack between the first car and the second car is reduced, at which time the propulsion vehicle pulls the first car and the second car. Thus, due to bunching, the propulsion vehicle may be able to build up momentum over time without having to pull the entire load of the vehicle system at once from a stopped position.

As stated above, the second objective may be to stop the vehicle system 102 such that multiple vehicles 108, 110 of the vehicle system 102 are bunched together when the vehicle system 102 is stopped, which enhances the ability for the vehicle system 102 to start moving again after the stop. The controller 136 may designate operational settings (e.g., according to a trip plan) that provide for fine control over the tractive efforts and braking efforts of the vehicle system 102 as the vehicle system 102 slows to a stop in order for the couplers 123 to attain the slack state. For example, the operational settings may control the braking subsystem to slow the vehicles consecutively such that each vehicle comes to a stop a fraction after the preceding vehicle in the vehicle system 102, which provides slack in the corresponding coupler 123. The controller 136 may designate the operational settings based on slack information received from string pots located between the vehicles. Stopping the vehicle system 102 in this way to achieve bunching may require more fuel consumption, emissions generation, and/or time than stopping the vehicle system 102 using operational settings designated to achieve the first objective. But, the operational settings designated to drive the vehicle system 102 to achieve the first objective would likely not be able to be used to achieve such bunching. Furthermore, due to benefit that bunching may provide the vehicle system 102 as the vehicle system 102 starts moving again, stopping the vehicle system 102 to achieve bunching may be more relevant or a higher priority than stopping the vehicle system 102 to achieve fuel efficiency or to save time, for example.

In a further example, the second objective includes moving the vehicle system 102 on the route 104 such that one or more wheels 120 of the vehicle system 102 retain adhesion with the route 104 to reduce wheel slip. Wheel slip is a phenomenon that typically occurs as the vehicle system 102 is braking or accelerating. A wheel 120 may "slip" on the route 104 when the rotational force in a forward direction (e.g., when accelerating) or in a reverse direction (e.g., when braking) exceeds the frictional force between the wheel 120 and the route 104, so the wheel 120 rotates relative to the route 104. Wheel slip results in skidding of the wheel 120 along the route 104, which causes wheel and route wear, and could cause more damage (e.g., such as a derailment) if not timely repaired. Wheel slip wears the wheels 120 and the route 104 to the extent that the wheels 120 and applicable segments of the route 104 must be replaced more often than would otherwise be required, so avoiding wheel slip is desirable from both an economic and a safety perspective.

As stated above, the second objective may be to move the vehicle system 102 on the route 104 such that one or more wheels 120 of the vehicle system 102 retain adhesion with the route 104 to reduce wheel slip. The controller 136 may designate operational settings (e.g., according to a trip plan) that provide for fine control over the tractive efforts and braking efforts of the vehicle system 102 as the vehicle system 102 brakes and/or accelerates at speeds below the threshold speed to reduce the risk of wheel slip. For example, the operational settings may control the braking subsystem to slow the vehicles gradually over a period of time in order to reduce the rotational force on each wheel 120. For example, the period of time that the brakes are applied in accordance with the operational settings to achieve the second objective may be longer than the period of time that the brakes may be applied in accordance with operational settings designated to achieve the first objective (such as fuel efficiency or reduced travel time). Thus, the additional time and/or distance for braking allows for a reduction in the rotational force applied on the wheels 120, such that wheel slip is less likely than if the vehicle system 102 is being stopped according to the operational settings to achieve the first objective. For example, if the first objective is to reduce travel time, the operational settings may control the vehicle system 102 to apply the brakes at a later time and/or location and at a greater setting to reduce the time spent slowing the vehicle system 102. But, the greater brake application may cause wheel slip which may result in costly repairs to the vehicle system 102 and/or the route 104. Although the example above concerns the application of the brakes by the braking subsystem, the operational settings may also control the propulsion subsystem to accelerate the vehicle system 102 gradually over a period of time in order to reduce the forward rotational force on each wheel 120. At speeds below the designated threshold speed, the potential costs of wheel slippage (e.g., replacing segments of the route 102 and/or wheels and other equipment on the vehicle system 102) may be more of a concern than the benefits of controlling the vehicle to improve fuel consumption, to reduce emissions, or to reduce travel time.

The preceding examples of possible second objectives are exemplary only, and are not intended to be limiting. Optionally, the second objective may include more than one of the objectives listed above. For example, the operational settings may be designated to stop the vehicle system 102 within a designated threshold distance of a designated stopping location while controlling multiple vehicles of the vehicle system 102 to be bunched together once the vehicle system 102 is stopped.

In an embodiment, the controller 136 monitors the progress of the vehicle system 102 along the route 104 during a trip. For example, the controller 136 may compare the actual movements of the vehicle system 102 to the projected movements of the vehicle system 102 in a trip plan to determine whether to modify or update the trip plan. In addition, the controller 136 may monitor the operating condition of the vehicle system 102 relative to the designated threshold to determine when to switch between the first operating mode and the second operating mode (e.g., to determine whether the first objective or the second objective is appropriate). The controller 136 may receive speed parameters associated with a current speed of the vehicle system 102 from the speed sensor 116. The controller 136 may compare the current speed of the vehicle system 102 to the threshold speed to determine whether to operate in the first or second operating mode. The controller 136 also may receive location parameters from the locator device 124 to determine a proximity of the vehicle system 102 to designated locations (such as stopping locations).

Referring to the speed profile 200, the vehicle system 102 starts moving on the trip from the departure location at time $T_1$. From time $T_1$ to time $T_2$, the speed of the vehicle system 102 increases, but the speed is below the threshold speed $V_{TH}$. Thus, the controller 136 operates in the second operating mode, and the controller 136 designates operational settings (e.g., according to a trip plan) to drive the vehicle system 102 toward achievement of the second objective. For example, as the vehicle system 102 accelerates from time $T_1$ to $T_2$, the second objective may be to reduce wheel slip. The speed of the vehicle system 102 surpasses the threshold speed $V_{TH}$ at time $T_2$ and travels faster than the threshold speed $V_{TH}$ until time $T_3$. The speed sensor 116 is used to determine when the vehicle system 102 crosses the threshold speed $V_{TH}$. The controller 136 therefore operates in the first operating mode between times $T_2$ and $T_3$, such that the designated operational settings may drive the vehicle system 102 toward achievement of the first objective (e.g., reducing fuel consumption, emissions generation, and/or total travel time). Although the route 104 has a designated speed limit $V_L$, the vehicle system 102 may travel slower than the speed limit in order to improve fuel efficiency or reduce emissions as compared to the vehicle system 102 traveling at the speed limit $V_L$.

The vehicle system 102 may slow to a stop at a designated stopping location roughly midway along the duration of the trip. As the vehicle system 102 slows, the speed of the vehicle system 102 falls below the threshold speed $V_{TH}$ at time $T_3$. Thus, as the vehicle system 102 slows to a stop after time $T_3$, the controller 136 may designate operational settings that drive the vehicle system 102 to achieve the second objective. The second objective may be to stop the vehicle system 102 within a threshold distance from a designated location, to stop the vehicle system 102 such that the vehicles are bunched, to slow the vehicle system 102 to reduce wheel slip, or the like. Once the vehicle system 102 starts moving along the trip again, the speed does not surpass the threshold speed $V_{TH}$ until $T_4$. Optionally, from $T_4$ to $T_5$, the vehicle system 102 may be subject to a slow order (e.g., a temporary reduced speed limit), which explains the reduced speed. The vehicle system 102 may subsequently slow again due to a different slow order. The second slow order may force the vehicle system 102 to travel slower than the threshold speed $V_{TH}$ between times $T_6$ and $T_7$. Thus, the controller 136 may designate operational settings that control the vehicle system 102 to achieve the second objective from time $T_6$ to $T_7$ even though the vehicle system 102 does not come to a stop during this period of time. The vehicle system 102 travels faster than the threshold speed $V_{TH}$ between times $T_7$ and $T_8$. The vehicle system 102 arrives at the destination location at time $T_9$. From time $T_8$ to time $T_9$, the controller 136 operates in the second operating mode to control movement of the vehicle system 102 to achieve the second objective.

Optionally, the controller 136 may generate a single trip plan prior to the trip of the vehicle system 102. The trip plan includes both operational settings toward achievement of the first objective and operational settings toward achievement of the second objective. Thus, when the controller 136 determines that the speed of the vehicle system 102 crosses the designated threshold speed $V_{TH}$, the controller 136 implements the operational settings of the trip plan that corresponds to the objective associated with the speed. In an alternative embodiment, the controller 136 designates a single trip plan, but the trip plan only includes operational settings that drive the vehicle system 102 toward achievement of the first objective or the second objective, but not both. Thus, as the vehicle system 102 travels at a speed that corresponds to the objective of the trip plan, the controller 136 implements the operational settings of the trip plan. But, when the speed of the vehicle system 102 crosses the threshold speed $V_{TH}$, the controller 136 may be configured to generate a modification or update to the trip plan, where the modification designates operational settings to drive the vehicle system 102 toward achievement of the other objective. The controller 136 may generate the modified trip plan in real time during the trip. In another embodiment, instead of a single trip plan, the controller 136 may designate two different trip plans for the trip. The first trip plan includes operational settings toward achievement of the first objective, and the second trip plan includes operational settings toward achievement of the second objective. The controller 136 monitors the speed of the vehicle system 102 during the trip relative to the threshold speed $V_{TH}$ to determine whether to implement the operational settings of the first trip plan or the second trip plan.

In an alternative embodiment, the controller 136 does not generate the one or more trip plans for the trip. Instead, the trip plan(s) may be computed previously by the controller 136 for a previous trip of the vehicle system 102 or by a different control system. During the trip of the vehicle system 102, the controller 136 accesses the one or more trip plans and designates operational settings to drive the vehicle system 102 according to the one or more trip plans. The controller 136 selects which trip plan and/or which operational settings to designate as the vehicle system 102 travels based on the monitored speed of the vehicle system 102 relative to the threshold speed $V_{TH}$. Thus, even if the controller 136 does not generate the trip plan specific to an upcoming trip, the controller 136 still designates operational settings that have changing objectives based on the operating condition of the vehicle system 102.

Figure 3:
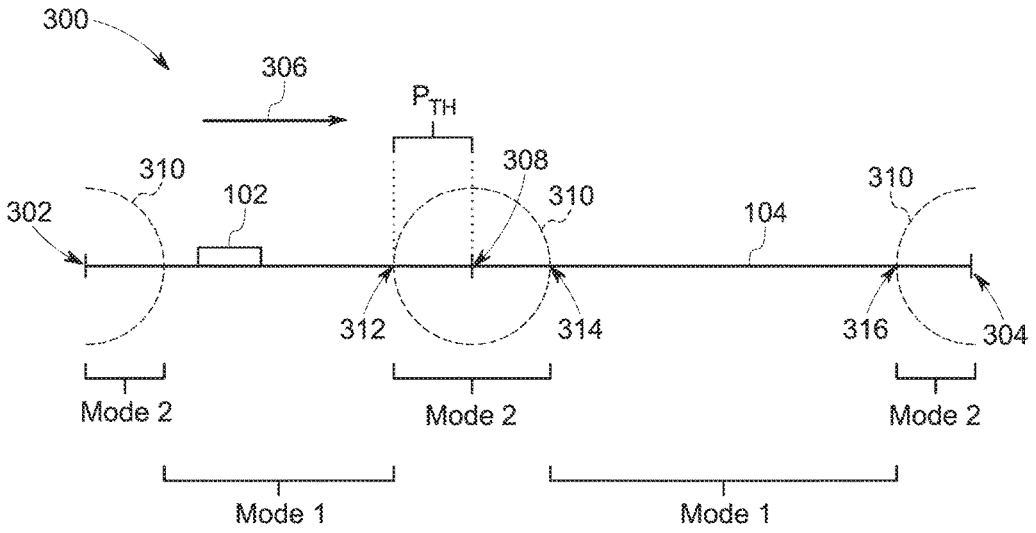
FIG. 3 is a schematic diagram showing a route profile of the vehicle system traveling on a segment of the route during a trip.

FIG. 3 is a schematic diagram showing a route profile 300 of the vehicle system 102 traveling on a segment of the route 104 during a trip. The segment of the route 104 extends from a starting location 302 to an ending location 304. The starting location 302 may be a departure location for the trip and/or the ending location 304 may be a destination location for the trip. The route profile 300 illustrates the distance between the starting location 302 and the ending location 304. The vehicle system 102 on the route 104 travels from the starting location 302 towards the ending location 304 in a forward direction 306. The trip also designates a break location 308 where the vehicle system 102 is scheduled to stop for a period of time. The designated break location 308 is located just less than half way across the segment of the route 104 on the illustrated route profile 300.

In an embodiment, the operating condition that is used to determine the operating mode of the controller 136 is a proximity of the vehicle system 102 to a designated location along the route 104. The designated threshold is a threshold proximity (shown in FIG. 3 as $P_{TH}$). The proximity of the vehicle system 102 to a designated location may be used as the operating condition instead of, or in addition to, the speed of the vehicle system 102. In an embodiment, the controller 136 may operate in a first operating mode when the location of the vehicle system 102 is at least at or outside of the threshold proximity from a designated location along the route 104. Conversely, the controller 136 operates in the second operating mode when the location of the vehicle system 102 is within the threshold proximity of one of the designated locations. Thus, when the vehicle system 102 is within the threshold proximity, the operational settings are designated to drive the vehicle system 102 toward achievement of the second objective, such as to provide fine motor control for accurate stopping, bunching of the vehicles, and/or reduced wheel slip. On the other hand, when the vehicle system 102 is outside of the threshold proximity, the operational settings are designated to drive the vehicle system 102 toward achievement of the first objective, such as to reduce fuel consumption, emissions generation, and/or total travel time. Although distance or proximity is being used as the operating condition in this embodiment instead of speed, optionally the first and second operating modes of the controller 136 (and the first and second objectives of the trip) may be the same as described above.

The threshold proximity is a distance that is selected prior to the trip. The threshold proximity may be on the order of kilometers or miles. For example, the threshold proximity may be a distance between 0.5 miles and 3 miles, or, more specifically, between 1 to 2 miles. In various embodiments, the threshold proximity could be 1 mile, 1.5 miles, or 2 miles from a designated location. The threshold proximity may be determined based on the specific vehicle system or route. For example, the threshold proximity may be longer if the grade of the route is downhill (which would require more braking force) and/or if the vehicle system has relatively poor braking abilities compared to other vehicle systems that travel on the route 104. Other considerations may include the size of the vehicle system, including weight, and the speed that the vehicle system travels outside of the threshold proximity, which could affect the inertia of the vehicle system.

In an embodiment, the controller 136 monitors the progress of the vehicle system 102 along the route 104 during the trip. The controller 136 may receive location parameters associated with a current location of the vehicle system 102 communicated from the locator device 124. The controller 136 may compare the current location of the vehicle system 102 to the location of the nearest designated location to determine the operating mode of the controller 136. For example, the controller 136 may measure a proximity of the vehicle system 102 to the designated location, and the controller 136 may compare the measured proximity to the threshold proximity to determine if the vehicle system 102 is within the threshold proximity or not at a given time. In another example, the controller 136 knows the location of the designated locations, and the controller 136 determines a threshold boundary line by adding and subtracting the distance of the threshold proximity to each of the designated locations. Then, the controller 136 uses the locator device 124 to determine when the vehicle system 102 crosses one of the threshold boundary lines to know whether the vehicle system 102 is within the threshold proximity.

Referring to the route profile 300 of FIG. 3, the vehicle system 102 is currently located between the starting location 302 and the break location 308, and the vehicle system 102 is moving towards the break location 308. In FIG. 3, threshold boundary lines 310 are traced in dashed lines around the designated locations 302, 308, 304. The threshold boundary lines 310 are circular curves that have a radius of the threshold proximity $P_{TH}$. Thus, when the vehicle system 102 is within any of the boundary lines 310, the vehicle system 102 is less than the threshold proximity from a designated location, so the controller 136 operates in the second operating mode. In FIG. 3, the vehicle system 102 is not currently within any threshold boundary line 310, so the controller 136 operates in the first operating mode. The controller 136 designates operational settings that drive the vehicle system 102 toward achievement of the first objective in the first operating mode. Thus, at the illustrated position, the operational settings may be driving the vehicle system 102 in order to increase fuel efficiency, reduce emissions, or reduce total travel time.

When the vehicle system 102 crosses a point 312 to enter the threshold boundary line 310 surrounding the break location 308, the controller 136 switches to the second operating mode. In the second operating mode, the controller 136 designates operational settings that drive the vehicle system 102 toward achievement of the second objective, such as to accurately stop the vehicle system 102 at the break location 308, to provide bunching between the vehicles of the vehicle system, and/or to reduce wheel slip when slowing to a stop at the break location 308. The controller 136 remains in the second operating mode through the initial acceleration of the vehicle system 102 from the break location 308 until the vehicle system 102 crosses another point 314 at the back end of the threshold boundary line 310 surrounding the break location 308. Then, the controller 136 operates in the first operating mode (designating operational settings to drive the vehicle system 102 toward achievement of the first objective) until the vehicle system 102 crosses a point 316 to enter the threshold boundary line 310 surrounding the ending location 304 of the segment of the route 104. From the point 316 to the ending location 304, the controller 136 operates in the second operating mode. Thus, as with the embodiment shown in FIG. 2, when the vehicle system 102 is approaching a stop location or accelerating from a stop location, the controller 136 operates in the second operating mode to provide fine motor control of the vehicle system 102. But, when the vehicle system 102 is not near a stop location, the controller 136 operates in the first operating mode to provide fuel efficiency, reduced emissions, and/or reduced travel time.

In the embodiments shown in FIGS. 2 and 3, the controller 136 is described as having two operating modes depending on whether the operating condition is over a threshold or below the threshold. Optionally, the controller 136 may have more than two operating modes in order to designate operational settings that have at least three different objectives depending on the operating condition of the vehicle system 102. For example, the controller 136 may compare actual operating conditions of the vehicle system 102 to two designated thresholds. The operating mode of the controller 136 could be determined based on whether the operating condition is below both thresholds, is between the two thresholds, or is above both thresholds. Thus, the control system 100 may be configured to differentiate and control the vehicle system 102 toward the achievement of more than two different objectives.

Figure 4:
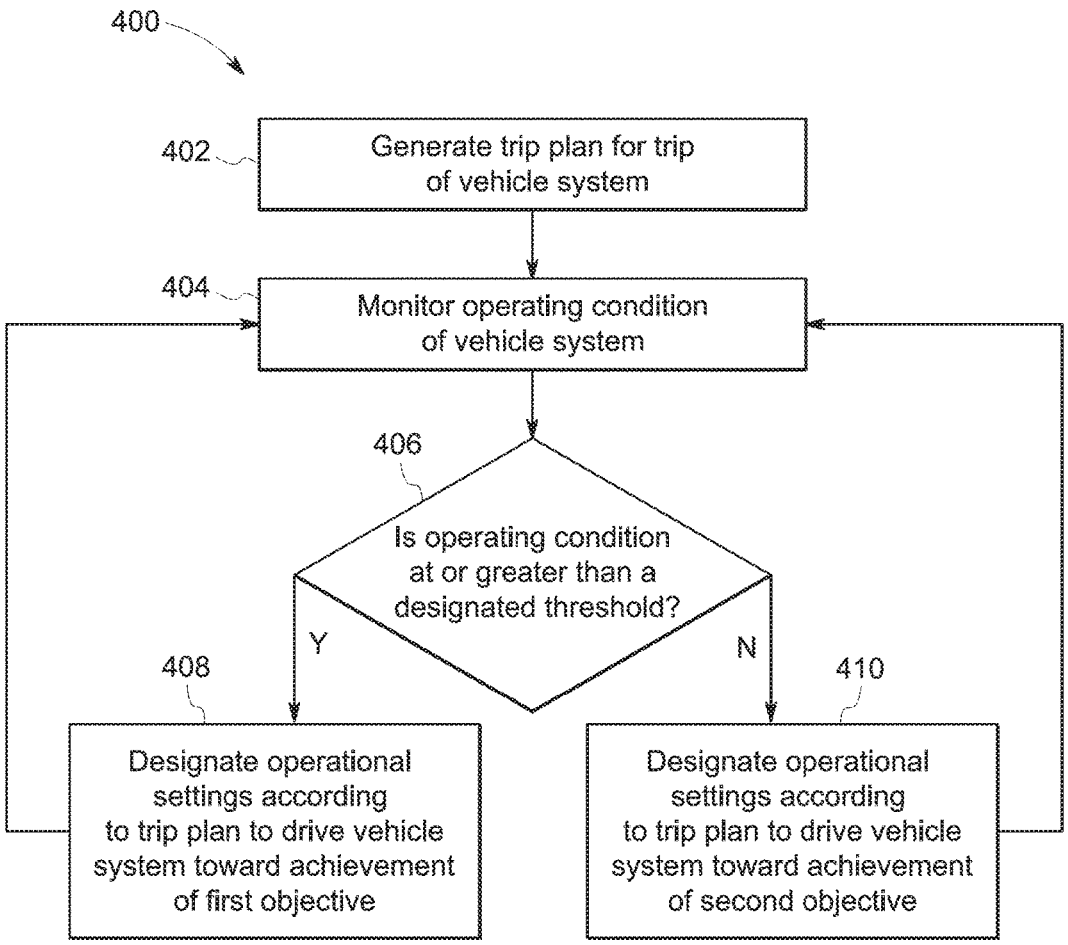
FIG. 4 is a flow chart of one embodiment of a method for controlling a vehicle system that travels on a route.

FIG. 4 is a flow chart of one embodiment of a method 400 for controlling a vehicle system that travels on a track along a route. At 402, a trip plan for a trip of the vehicle system along the route is generated. The trip plan may be generated by a controller that includes one or more processors. The trip plan designates one or more operational settings for the vehicle system as a function of one or more of time or distance along the route. The operational settings are designated to drive the vehicle system toward achievement of one or more objectives of the trip plan. Generating the trip plan may include designating one or more of speeds, throttle settings, brake settings, or accelerations as the operational settings of the trip plan. The trip plan may be generated to drive the vehicle system toward achievement of the one or more objectives while satisfying one or more of speed limits, vehicle capability constraints, trip schedule times, or emissions limits.

At 404, an operating condition of the vehicle system is monitored as the vehicle system travels along the route during the trip. In one embodiment, the operating condition may be a speed of the vehicle system. In another embodiment, the operating condition may be a proximity of the vehicle system to a designated location along the route, such as a designated stop location where the vehicle system is to slow to a stop. At 406, a determination is made whether the monitored operating condition is at least at or greater than a designated threshold. The designated threshold may be a threshold speed, such as a speed between 5 mph and 15 mph. The determination may be made by comparing a current speed of the vehicle system as monitored by a speed sensor to the designated threshold speed. Alternatively, the designated threshold may be a threshold proximity to a designated location for the trip, such as a stop location. The threshold proximity may be a distance of 1 mile or 2 miles from a stop location. The determination may be made by comparing a current location of the vehicle system as monitored by a locator device to the location of the nearest stop location and measuring whether that distance is more or less than the designated threshold proximity.

If the operating condition is at or greater than the designated threshold (e.g., such as the speed of the vehicle system being faster than the threshold speed or the distance of the vehicle system to a stop location being further than the threshold proximity), flow of the method 400 proceeds to 408. At 408, operational settings according to the trip plan are designated to drive the vehicle system toward achievement of a first objective. The first objective may include one or more of a reduction in fuel consumption or a reduction in emissions generation by the vehicle system relative to the vehicle system traveling along the route for the trip according to operational settings that differ from the one or more operational settings of the trip plan.

If, on the other hand, the operating condition at 406 is less than the designated threshold (e.g., such as the speed of the vehicle system being slower than the threshold speed or the distance of the vehicle system to a stop location being less than the threshold proximity), flow of the method 400 proceeds to 410. At 410, operational settings according to the trip plan are designated to drive the vehicle system toward achievement of a second objective that differs from the first objective. The second objective may be associated with fine control of the movements of the vehicle system. For example, the second objective may include moving the vehicle system to one or more locations that are within a designated threshold distance of one or more designated locations of the trip plan. More specifically, the second objective may include stopping the vehicle system at one or more locations that are within a designated threshold distance of one or more designated stopping locations of the trip plan. The second objective alternatively or additionally may include stopping the vehicle system such that multiple vehicles of the vehicle system are bunched together with one or more couplers disposed between the vehicles of the vehicle system in a slack state once the vehicle system is stopped according to the trip plan. Furthermore, the second objective may include moving the vehicle system on the route such that one or more wheels of the vehicle system retain adhesion with the route to reduce wheel slip.

Optionally, the method 400 may further include communicating a control signal to at least one of a propulsion subsystem, a braking subsystem, or a user interface device of the vehicle system. The control signal may include at least some of the operational settings of the trip plan. The operational settings in the control signal may be implemented by the recipient of the control signal, such as autonomously or via human intervention.

At least one technical effect of the various embodiments described herein is determining and implementing a driving and/or operating strategy of a powered vehicle system to improve at least certain objective operating criteria while satisfying schedule, speed, and other constraints. Another technical effect is the ability for the vehicle system to achieve different objectives during the route based on which objectives are relevant at different operating conditions of the vehicle system along the route. A further technical effect is increased control of the vehicle system throughout the trip, including at or near stopping locations, such that the vehicle system is able to stop within a designated threshold distance of a designated stopping location. The increased control may allow multiple vehicles of the vehicle system to have a designated amount of slack between the vehicles when the vehicle system is stopped. The increased control may also allow for a decreased likelihood of wear of the vehicle system and/or the route near stopping locations attributable to wheel slip.

In one embodiment, a method (e.g., for controlling a vehicle system along a route) includes generating a trip plan for a trip of the vehicle system along the route. The trip plan designates one or more operational settings for the vehicle system as a function of one or more of time or distance along the route. The one or more operational settings are designated to drive the vehicle system toward achievement of one or more objectives of the trip plan. The trip plan is generated to drive the vehicle system during the trip toward achievement of a first objective during movement of the vehicle system along the route at a speed that is at least as fast as a designated threshold speed. The trip plan is generated to drive the vehicle system during the trip toward achievement of a different, second objective during movement of the vehicle system along the route at a speed that is slower than the designated threshold speed.

In an aspect, generating the trip plan includes designating one or more of speeds, throttle settings, brake settings, or accelerations as the operational settings of the trip plan.

In another aspect, the first objective includes one or more of a reduction in fuel consumption by the vehicle system, a reduction in emissions generation by the vehicle system, an improvement in handling of the vehicle system, or a reduction in travel time relative to the vehicle system traveling along the route for the trip according to operational settings that differ from the one or more operational settings of the trip plan.

In another aspect, the second objective includes moving the vehicle system to one or more locations that are within a designated threshold distance of one or more designated locations of the trip plan.

In another aspect, the second objective includes stopping the vehicle system at one or more locations that are within a designated threshold distance of one or more designated stopping locations of the trip plan.

In another aspect, the second objective includes stopping the vehicle system such that multiple vehicles of the vehicle system are bunched together with one or more couplers disposed between the vehicles of the vehicle system in a slack state once the vehicle system is stopped according to the trip plan.

In another aspect, the second objective includes moving the vehicle system on the route such that one or more wheels of the vehicle system retain adhesion with the route to reduce wheel slip.

In another aspect, the designated threshold speed is a speed between 5 miles per hour and 15 miles per hour.

In another aspect, the method further includes monitoring the speed of the vehicle system as the vehicle system travels along the route during the trip and comparing the speed to the designated threshold speed.

In another aspect, the method further includes communicating a control signal to at least one of a propulsion subsystem, a braking subsystem, or a user interface device of the vehicle system. The control signal includes at least some of the operational settings of the trip plan.

In another aspect, the trip plan is generated to drive the vehicle system during the trip toward achievement of at least one of the first objective or the second objective while satisfying one or more of speed limits, vehicle capability constraints, trip schedule times, or emissions limits.

In another embodiment, a system (e.g., a control system for controlling a vehicle system along a route) includes a sensor and a controller that includes one or more processors. The sensor is configured to monitor an operating condition of the vehicle system during movement of the vehicle system along the route for a trip. The controller is configured to designate one or more operational settings for the vehicle system as a function of one or more of time or distance along the route. The one or more operational settings are designated to drive the vehicle system toward achievement of one or more objectives for the trip. The controller is operable in at least two operating modes including a first operating mode and a second operating mode. The controller operates in the first operating mode when the operating condition of the vehicle system is at least one of at or above a designated threshold. The controller in the first operating mode is configured to designate operational settings to drive the vehicle system during the trip toward achievement of a first objective during movement of the vehicle system along the route. The first objective includes one or more of a reduction in fuel consumption or a reduction in emissions generation by the vehicle system relative to the vehicle system traveling along the route for the trip according to operational settings that differ from the one or more operational settings designated by the controller. The controller operates in the second operating mode when the operating condition of the vehicle system is below the designated threshold. The controller in the second operating mode is configured to designate operational settings to drive the vehicle system during the trip toward achievement of a different, second objective during movement of the vehicle system along the route.

In an aspect, the operating condition of the vehicle system is a speed of the vehicle system along the route, and the designated threshold is a threshold speed. The sensor may be a speed sensor that is configured to determine the speed of the vehicle system along the route. The speed sensor may be configured to communicate the speed of the vehicle system to the controller. The controller may be configured to compare the speed of the vehicle system to the threshold speed.

In another aspect, the operating condition of the vehicle system is a proximity of the vehicle system to a designated location along the route for the trip, and the designated threshold is a threshold proximity. The sensor may be a locator device configured to determine a location of the vehicle system along the route. The locator device may be configured to communicate the location of the vehicle system to the controller. The controller may be configured to determine the proximity of the vehicle system to the designated location and compare the proximity to the threshold proximity.

In another aspect, the controller is configured to designate one or more of speeds, throttle settings, brake settings, or accelerations for the vehicle system as the operational settings.

In another aspect, the second objective includes moving the vehicle system to one or more locations that are within a designated threshold distance of one or more designated locations of the trip.

In another aspect, the second objective includes stopping the vehicle system such that multiple vehicles of the vehicle system are bunched together with one or more couplers disposed between the vehicles of the vehicle system in a slack state once the vehicle system is stopped.

In another aspect, the second objective includes moving the vehicle system on the route such that one or more wheels of the vehicle system retain adhesion with the route to reduce wheel slip.

In another aspect, the controller is further configured to communicate a control signal to at least one of a propulsion subsystem, a braking subsystem, or a user interface device of the vehicle system. The control signal includes at least some of the operational settings designated by the controller.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described herein without departing from its scope. While the dimensions and types of materials described herein are intended to define the parameters of the disclosed subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, including the best mode, and also to enable a person of ordinary skill in the art to practice the embodiments of inventive subject matter, including making and using any devices or systems and performing any incorporated methods. The patentable scope of the inventive subject matter is defined by the claims, and may include other examples that occur to a person of ordinary skill in the art. Such other examples are intended to be within the scope of the claims if they have structural elements that do not differ from the literal language of the claims, or if they include equivalent structural elements with insubstantial differences from the literal languages of the claims.

Since certain changes may be made in the above-described systems and methods, without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A system comprising:

at least a first sensor configured to monitor at least one operating condition of a vehicle system while traveling a route from a first location to at least a second location;

a control system, the control system including at least one or more processors, the control system configured to receive data communicated from the at least first sensor and to generate a trip plan that includes plural designated operational settings for control of the vehicle system during a trip;

wherein the operational settings include at least a first operational mode and second operational mode, wherein the second operational mode includes stopping the vehicle system such that multiple vehicles of the vehicle system are bunched together with one or more couplers disposed between the vehicles of the vehicle system in a slack state once the vehicle system is stopped;

wherein the control system is configured to control the vehicle system in the first operational mode responsive to the operating condition of the vehicle system being at least one of at or above a designated threshold; and wherein the control system is configured to control the vehicle system in the second operational mode responsive to the operating condition of the vehicle system being below the designated threshold.

2. The system of claim 1, wherein the at least one operating condition of the vehicle system is a speed of the vehicle system along the route, and the designated threshold is a threshold speed.

3. The system of claim 2, wherein the sensor is a speed sensor configured to determine the speed of the vehicle system along the route, the speed sensor configured to communicate the speed of the vehicle system to the control system, the control system configured to compare the speed of the vehicle system to the threshold speed.

4. The system of claim 1, wherein the at least one operating condition of the vehicle system is a proximity of the vehicle system to a designated location along the route for the trip, and the designated threshold is a threshold proximity.

5. The system of claim 4, wherein the sensor is a locator device configured to determine a location of the vehicle system along the route, the locator device being configured to communicate the location of the vehicle system to the control system, the control system configured to determine the proximity of the vehicle system to the designated location and compare the proximity to the threshold proximity.

6. The system of claim 1, wherein the control system is configured to designate one or more of speed, throttle settings, brake settings, or accelerations for the vehicle system as the operational settings.

7. The system of claim 1, wherein the control system is further configured to communicate a control signal to at least one of a propulsion subsystem, a braking subsystem, or a user interface device of the vehicle system, the control signal including at least some of the operational settings designated by the controller.

8. The system of claim 1, wherein the first operational mode includes controlling a speed of vehicle system to be above a threshold speed.

9. The system of claim 1, wherein the second operational mode includes stopping the vehicle system within a designated threshold distance of a designated stopping location.

10. The system of claim 1, wherein the second operational mode includes stopping the vehicle system such that each of the vehicles comes to a stop after a preceding vehicle of the vehicles in the vehicle system.

11. The system of claim 1, wherein the second operational mode includes stopping the vehicle system such that one or more wheels of the vehicle system retain adhesion with the route.

12. The system of claim 1, wherein the second operational mode includes controlling a distance between the vehicles of the vehicle system.

13. The system of claim 1, wherein the second operational mode includes controlling a tension between the vehicles of the vehicle system.

14. The system of claim 1, wherein the first operational mode includes the operational settings that drive the vehicle system during the trip toward achievement of a first objective during movement of the vehicle system along the route based on the trip plan.

15. The system of claim 1, wherein the second operational mode includes the operational settings that drive the vehicle system during the trip toward achievement of a second objective during movement of the vehicle system along the route based on the trip plan.

16. A method comprising:

monitoring, with at least one sensor, at least one operating condition of a vehicle system as the vehicle system travels along a route;

communicating data from the sensor to a control system, the control system comprising a processor to determine if the at least one operating condition is above or below a designated threshold and the control system is configured to designate one or more operational settings for the vehicle system;

generating a trip plan for the vehicle system that designates operating settings for at least a first operational mode and designates operating settings for at least a second operational mode, the second operational mode including stopping the vehicle system such that multiple vehicles of the vehicle system are bunched together with one or more couplers disposed between the vehicles of the vehicle system in a slack state once the vehicle system is stopped according to the trip plan; and controlling movement of the vehicle system as the vehicle system travels along the route according to the operating settings designated by the trip plan.

17. The method of claim 16, wherein generating the trip plan includes designating one or more of speeds, throttle settings, brake settings, or accelerations as the operating settings of the trip plan.

18. The method of claim 16, wherein the first operational mode includes reducing fuel consumption by the vehicle system.

19. The method of claim 16, wherein the first operational mode includes reducing emissions generated by the vehicle system.

20. The method of claim 16, wherein the first operational mode includes a change in handling of the vehicle system.

21. The method of claim 16, wherein the first operational mode includes a reduction in travel time relative to the vehicle system traveling along the route for the trip according to operational settings that differ from the one or more operational settings of the trip plan.

* * * * *